US010124203B1

(12) United States Patent
Brookshire

(10) Patent No.: US 10,124,203 B1
(45) Date of Patent: Nov. 13, 2018

(54) STUDENT DESK FOR BRAIN BASED MOVEMENT

(71) Applicant: Geoffrey B. Brookshire, Hendersonville, NC (US)

(72) Inventor: Geoffrey B. Brookshire, Hendersonville, NC (US)

( * ) Notice: Subject to any disclaimer, the term of this patent is extended or adjusted under 35 U.S.C. 154(b) by 373 days.

(21) Appl. No.: 15/091,760

(22) Filed: Apr. 6, 2016

Related U.S. Application Data

(63) Continuation-in-part of application No. 15/002,614, filed on Jan. 21, 2016.

(51) Int. Cl.

| | |
|---|---|
| ***A47C 7/68*** | (2006.01) |
| ***A63B 21/04*** | (2006.01) |
| ***A47B 39/02*** | (2006.01) |
| ***A47B 41/02*** | (2006.01) |
| ***A47C 7/50*** | (2006.01) |
| ***A47C 3/18*** | (2006.01) |
| ***A47B 9/20*** | (2006.01) |
| ***A47C 7/02*** | (2006.01) |
| ***A47C 7/44*** | (2006.01) |
| *A47D 3/00* | (2006.01) |

(52) U.S. Cl.
CPC ..... *A63B 21/04* (2013.01); *A47B 9/20* (2013.01); *A47B 39/02* (2013.01); *A47B 41/02* (2013.01); *A47C 3/185* (2013.01); *A47C 7/02* (2013.01); *A47C 7/44* (2013.01); *A47C 7/506* (2013.01); *A63B 21/0442* (2013.01); *A47C 7/68* (2013.01); *A47D 3/005* (2013.01)

(58) Field of Classification Search
CPC ..... A63B 21/04; A47B 9/20; A47B 39/02; A47B 41/02; A47B 3/063; A47D 3/005
USPC ..... 297/135–174 CS, 256.12, 344.21
See application file for complete search history.

(56) References Cited

U.S. PATENT DOCUMENTS

| | | | |
|---|---|---|---|
| 3,259,081 | A | 7/1966 | Stalnacke |
| 3,896,744 | A | 7/1975 | Goebl |
| 4,067,610 | A | 1/1978 | Doerr et al. |

(Continued)

*Primary Examiner* — Syed A Islam
(74) *Attorney, Agent, or Firm* — Chambliss, Bahner & Stophel, P.C.

(57) ABSTRACT

A student desk promoting brain-based movement. The student desk provides a frame carrying a table and a seat and a combination of one or more features designed to allow productive movement that stimulates and enhances cognitive learning. Various aspects of the student desk include semispherical seating surface, a rotatable seat with twist resistance, a cushioned seating surface, a height adjustable table, a sensory strip on the bottom of the table, and resistance bands secured to the frame. These enhancements provide a number of different outlets for students to release nervous energy in a non-disruptive manner while remaining focused on educational activities. These enhancements allow knowledge instruction to be combined with brain-based movement, which generates increased brain activity during learning scenarios, empowers students to self-regulate emotions without disrupting class, and creates opportunities for students to enhance academic performance by developing more adaptive cognitive relationships with the academic material. The student desk is particularly well-suited for use by special needs learners and other students requiring or benefiting from physical stimulation or tactile stimulation.

19 Claims, 7 Drawing Sheets

(56) References Cited

U.S. PATENT DOCUMENTS

| | | | | |
|---|---|---|---|---|
| 5,107,775 | A | 4/1992 | Langlais et al. | |
| 5,289,782 | A | 3/1994 | Rizzi et al. | |
| 5,522,641 | A * | 6/1996 | Infanti | A47C 9/00 297/172 |
| 5,651,583 | A | 7/1997 | Klingler et al. | |
| 5,685,510 | A | 11/1997 | Frankish | |
| 5,755,650 | A | 5/1998 | Urso | |
| 6,119,605 | A | 9/2000 | Agee | |
| 6,336,681 | B1 | 1/2002 | Crosbie | |
| 6,383,130 | B1 | 5/2002 | Wade et al. | |
| 7,137,935 | B2 | 11/2006 | Clarke et al. | |
| 7,147,284 | B2 | 12/2006 | Mills et al. | |
| 7,381,168 | B2 * | 6/2008 | Bowser | A63B 21/04 482/121 |
| 7,537,553 | B2 | 5/2009 | Mongelluzzo et al. | |
| 7,571,959 | B2 | 8/2009 | Griepentrog | |
| 8,434,748 | B1 | 5/2013 | Pearce et al. | |
| 8,439,442 | B2 | 5/2013 | Highlander et al. | |
| 2004/0066074 | A1 * | 4/2004 | Ovitt | A47C 3/18 297/344.21 |
| 2005/0099040 | A1 * | 5/2005 | Mills | A47B 39/02 297/170 |
| 2006/0082206 | A1 | 4/2006 | Travis | |
| 2008/0081748 | A1 | 4/2008 | Knapp | |
| 2009/0149698 | A1 | 6/2009 | Tastard | |
| 2009/0178596 | A1 * | 7/2009 | Skiba | A47B 9/14 108/102 |
| 2012/0001527 | A1 | 1/2012 | Choppla | |
| 2013/0187422 | A1 | 7/2013 | Schwinghammer et al. | |
| 2013/0331243 | A1 | 12/2013 | Walkama | |
| 2014/0008943 | A1 * | 1/2014 | Benden | A47B 39/00 297/135 |
| 2014/0045663 | A1 | 2/2014 | Dyderski | |
| 2014/0265495 | A1 * | 9/2014 | Bay | A47C 7/402 297/311 |

* cited by examiner

STUDENT DESK FOR BRAIN BASED MOVEMENT

CROSS-REFERENCE TO RELATED APPLICATIONS

This application is a continuation-in-part of U.S. patent application Ser. No. 15/002,614, filed Jan. 21, 2016, the disclosure of which is incorporated by reference herein in its entirety.

BACKGROUND

The core of classroom instruction involves lecture, practice, and testing. During classroom instruction, students typically remain seated for long periods of time and have limited opportunities to engage in physical activity. Conventional seating in classroom settings includes a chair and table providing students with a place to sit and an area to work. Examples of conventional classroom seating include the individual student desk and separate chair, the one-piece student desk and chair, and group tables and chairs. Conventional classroom seating addresses the basic utilitarian need of students to sit and take notes or tests. Durability and uniformity are primary design considerations. For institutional furniture, student comfort is a secondary consideration. As such, conventional classroom seating offers no adjustments and is constructed with hard and rigid materials for durability.

Students confined to conventional classroom seating might have a need to move around for various reasons. The student might be losing focus and need to engage in physical activity to restore alertness or is simply uncomfortable and is looking for a better seating position. Or, the student may have pent up energy that needs to be released. Getting up from one's seat and moving around during class is disruptive to the learning of the student who gets up, the other students in the class, and the lecturer. In addition to being disruptive, leaving one's seat during work times and testing reduces student productivity and raises concerns of cheating. However, conventional classroom seating offers no alternative. With no ability to engage in non-disruptive activities for stimulation or release, some students will inevitably fall asleep or otherwise drift off or find an outlet for their excess energy, often in a way that disturbs others in the classroom.

Conventional classroom seating is even more unforgiving for learners with special needs. The mental, emotional, or physical challenges faced by special needs students often make learning more difficult because they require more stimulation and outlets than regular students to cope with educational stress. America's classrooms are experiencing higher numbers of children who exhibit challenging behaviors, and too often teachers are spending precious instructional time on discipline issues. Students with mental health and developmental diagnoses deserve the right to an education that is appropriate to their needs. Some students may need additional time or a modified curriculum to help maintain emotional stability and avoid overstimulation. Fatigue and frustration greatly increase the likelihood that a student will exhibit behavior problems. Therefore, it is imperative that special needs students receive the most effective behavior management interventions available so they can develop greater self-control and discover untapped academic potential.

Special-needs learners diagnosed with autism spectrum disorder (ASD), attention deficit hyperactivity disorder (ADHD) as well as many different types of anxiety, conduct, and developmental disorders often get stuck in counterproductive mental states, and movement has been shown to successfully interrupt negative behavior patterns. Allowing a child with attention or impulse control issues the ability to move during learning activities helps activate the brain and trigger organic learning for body and brain. Requiring students to remain seated for extended periods does not promote optimal learning conditions and is particularly difficult for students with behavior and developmental challenges. Blending core curriculum with purposeful movement provides students the mental and physical stimulation to improve academic performance and achieve greater emotional and physical control.

There are desks and task chairs available, notably office furniture, that are adjustable and/or allow freedom to move. Office furniture incorporates materials, features, and adjustments for ergonomic comfort, such as height adjustable desks allowing users to sit or stand and chairs with adjustments for seat and/or arm rest height, adjustable lumbar supports. Task chairs typically have casters and spinning seats allowing users to move around their work area and perform various tasks without leaving their seat. Office chairs and recliners have reclining or flexible backrests offering comfort. While appropriate for office or home environments, such furniture would be counterproductive in a typical classroom. Such furniture requires more space than a typical student desk, which is a concern in a classroom where the occupancy per square foot is much higher than a typical office environment. In an institutional educational setting where a high number of students, high occupant turnover throughout the school day, and low occupant accountability are factors, the added expense of and likelihood of damage to adjustment features rendering the furniture worse than its non-adjustable counterpart, or even unusable, is not feasible for most school system budgets. Finally, while casters and spinning seats are efficient for task-based movement, such mobility has a high risk of contributing to disruptive behavior in a classroom environment, yet does little to provide educational enhancing stimulation and purposeful movement that enhances learning.

It is with respect to these and other consideration that the present invention was conceived.

BRIEF SUMMARY

The following summary discusses various aspects of the invention described more fully in the detailed description and claimed herein. It is not intended and should not be used to limit the claimed invention to only such aspects or to require the invention to include all such aspects.

Many students are under-stimulated at school. Increasing evidence indicates that altering classroom layout, activities, and instruction has a positive impact on the emotional stability and productivity of special needs learners. One psycho-educational intervention that is gaining interest and momentum in schools is brain-based movement. Recent research shows the brain functions more effectively and is better able to absorb information when movement is integrated into learning situations. Additionally, research indicates that combining movement with learning activities causes the brain to form new, more efficient connections as a result of simultaneous mental and physical challenges.

Researchers agree that the area of brain most associated with motor control is the cerebellum. The cerebellum takes up just one-tenth of the brain but contains nearly half of all the brain's neurons. Most of the cerebellum's neural circuits flow outward to influence many key areas of the brain involved in memory, attention, and spatial perception. During physical activity, the vestibular (inner ear), cerebellar (motor control), and reticular (attention control) systems gather data and send information through nerve impulses from the cerebellum to the rest of the brain. Brain-based movement activities initiate the interaction between the vestibular, cerebellar, and reticular systems which helps students to process information, turn thoughts into actions, and coordinate movements.

Incorporating brain-based movement interventions into classroom learning activities has a positive impact on the emotional stability and academic performance of special needs learners and benefits other students as well. Brain-based strategies incorporate purposeful movement into the academic curriculum, which has been proven to boost cognitive functioning and improve students' behavioral and physical health.

A student desk designed to promote brain-based movement in instructional settings includes a frame carrying a table and a seat and a combination of one or more features designed to allow productive movement that stimulates and enhances cognitive learning in an educational scenario. Various aspects of the student desk include semispherical seating surface, a rotatable seat with twist resistance, a cushioned seating surface, a height adjustable table, a sensory strip on the bottom of the table, and resistance bands secured to the frame. These enhancements provide a number of different outlets for students to release nervous energy in a non-disruptive manner while remaining focused on educational activities. These enhancements allow knowledge instruction to be combined with brain-based movement, which generates increased brain activity during learning scenarios, empowers students to self-regulate emotions without disrupting class, and creates opportunities for students to enhance academic performance by developing more adaptive cognitive relationships with the academic material. The student desk is particularly well-suited for use by special needs learners and other students requiring or benefiting from physical stimulation or tactile stimulation.

The student desk includes a frame supporting a table (i.e., work surface) and a seat. The frame includes a frame base, a table support carrying the table, and a seat support carrying the seat. The table optionally has one or more degrees of freedom to encourage educationally productive movement or postures and/or adjust the fit of the student desk. The seat optionally has one or more degrees of freedom relative to the seat support to encourage educationally productive movement and/or adjust the fit of the student desk. The frame base includes one or more elongated members arranged substantially horizontally and configured to rest upon a floor. The table support includes one or more elongated members located proximate to the front of and extending upwardly from the frame base. The seat support includes one or more elongated members located proximate to the rear of and extending upwardly from the frame base. The seat optionally includes a backrest.

Various aspects of the student desk are specifically designed to facilitate the incorporation of brain-based movement into the academic curriculum or to otherwise contribute to the physical and emotional comfort of the students during learning activities. One optional aspect is adjustability allowing the same student desk to be sized to accommodate different groups of students (e.g., elementary school students or high school students), to better fit individual students, or to convert the student desk between a sitting desk and a standing desk. Another optional aspect is to provide various opportunities for students to engage in the purposeful movements of brain-based movement that enhances learning without becoming a distraction. A still further optional aspect is to provide various integrated accessories with which students can interact and receive physical and mental stimulation to release physical and emotional energies in a calm, non-disruptive manner.

The student desk includes a number of features implementing the optional aspects described above. The optional features of the student desk include an adjustable height table, an adjustable depth table, an adjustable depth seat, an adjustable height seat, a spherical seating surface, a cushioned seating surface, a rotatable seat with twist resistance, a detachable or repositionable seat, a flexible backrest, a cushioned backrest, a tactile sensory strip, and resistance bands.

BRIEF DESCRIPTION OF THE DRAWINGS

Further features, aspects, and advantages of the present disclosure will become better understood by reference to the following figures, wherein elements are not to scale so as to more clearly show the details and wherein like reference numbers indicate like elements throughout the several views.

DETAILED DESCRIPTION

Figure 1:
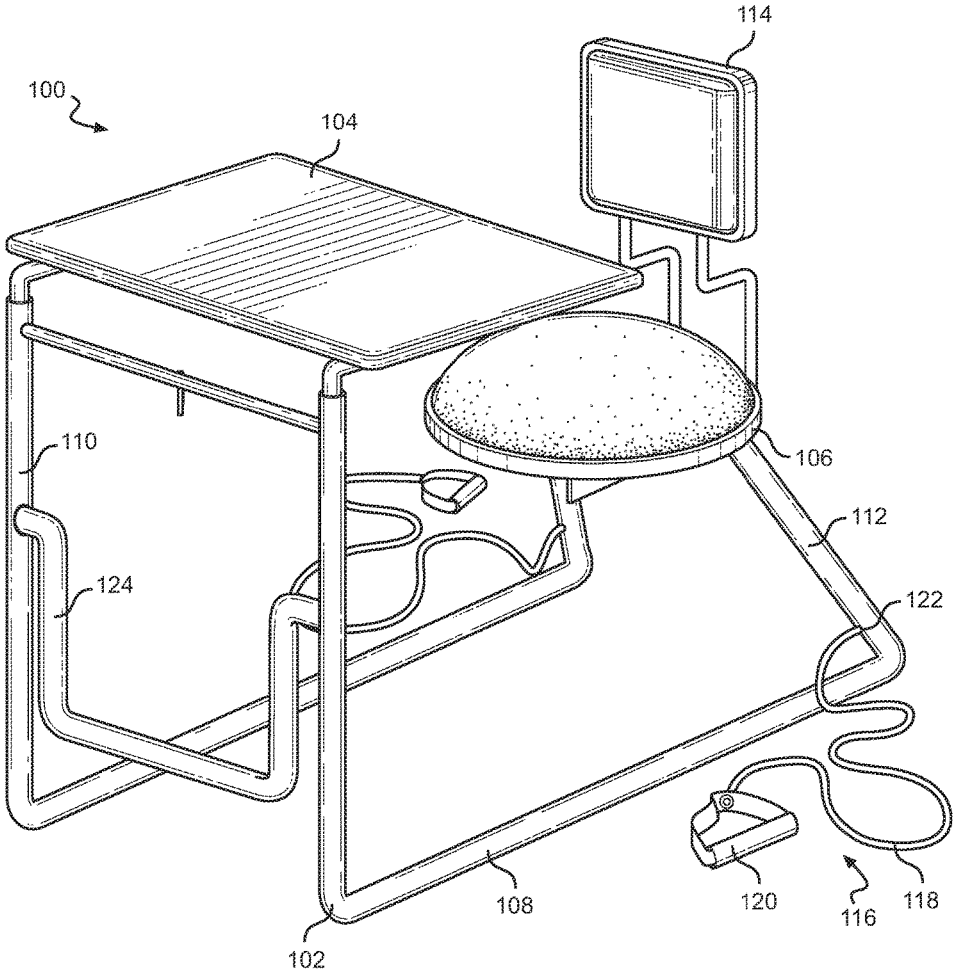
FIG. 1 is a perspective view illustrating aspects of a student desk according to the present invention.
Figure 2:
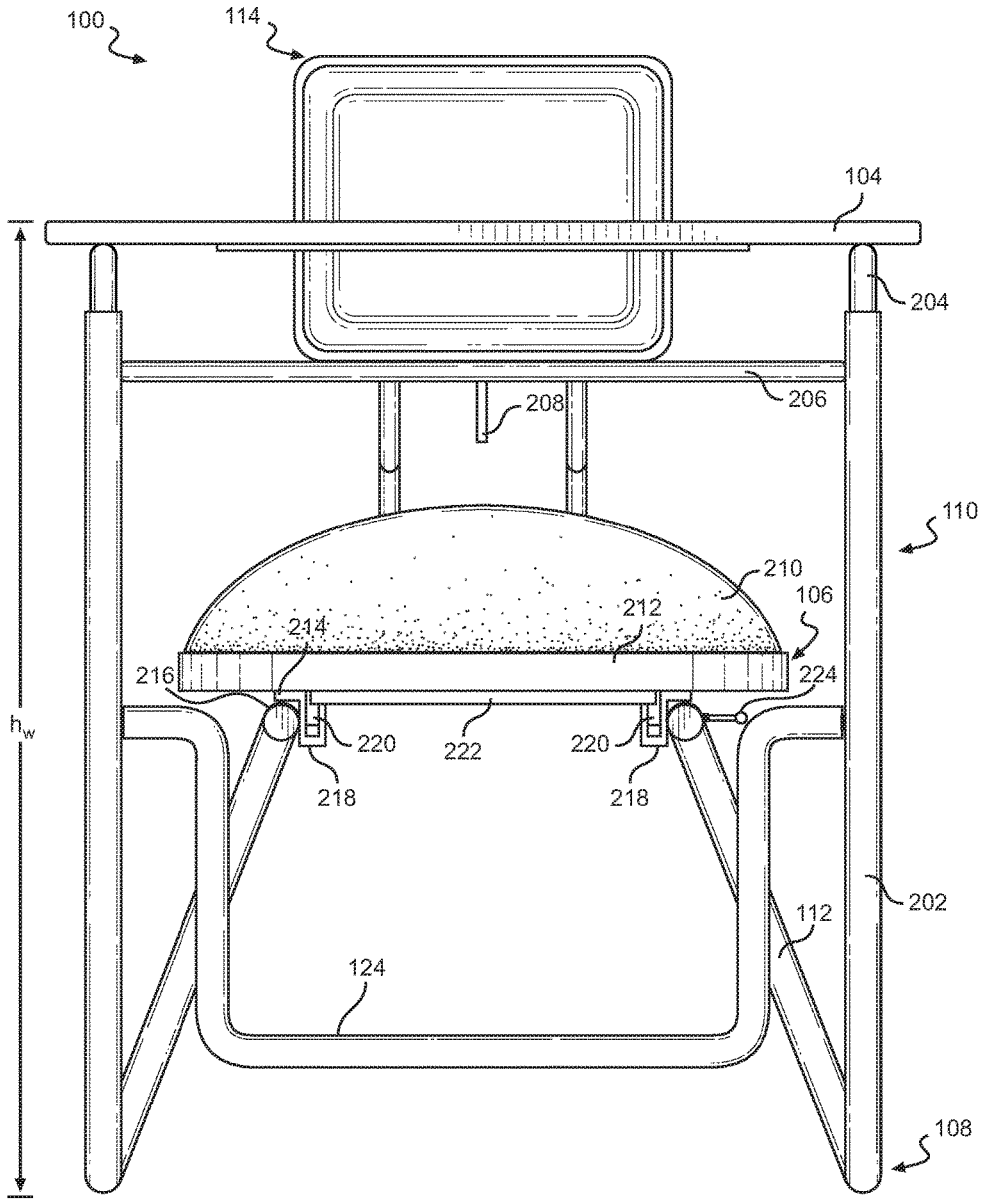
FIG. 2 is a front elevation illustrating aspects of the student desk.

Turning to FIGS. 1 and 2, the student desk 100 includes a unitary frame 102 supporting a table 104 (i.e., work surface) and a seat 106. The frame 102 includes a frame base 108, a table support 110 carrying the table 104, and a seat support 112 carrying the seat 106. The table 104 optionally has one or more degrees of freedom to encourage educationally productive movement or postures and/or adjust the fit of the student desk 100. The seat 106 optionally has one or more degrees of freedom relative to the seat support 112 to encourage educationally productive movement and/or adjust the fit of the student desk 100. The frame base 108 includes one or more elongated members arranged substantially horizontally and configured to rest upon a floor. The table support 110 includes one or more elongated members located proximate to the front of and extending upwardly from the frame base 108. The seat support 112 includes one or more elongated members located proximate to the rear of and extending upwardly from the frame base 108. The seat 106 optionally includes a backrest 114.

While the illustrated frame 102 is constructed using two widely spaced-apart, symmetrical, cylindrical frame members with an angled seat support 112, the frame 102 may have many different configurations without departing from the scope and spirit of the present invention. The frame 102 may be constructed using more or fewer frame members than shown. For example, the frame base 108, table support 110, and/or seat support 112 may be implemented using a single elongated member having one or more projections to provide stability or the spacing between various portions of the multiple frame members can vary from that shown. The frame 102 may have other cross-sectional shapes (e.g., square, rectangular, or other polygonal shapes). The seat support 112 may be vertically oriented rather than angled to accommodate some implementations of an adjustable height seat. In various embodiments, the table 104 and the seat 106 and any crossbars connecting spaced-apart frame members may be detachable from the frame 102 to allow the student desk to be disassembled for shipping or storage.

Various aspects of the student desk 100 are specifically designed to facilitate the incorporation of brain-based movement into the academic curriculum or to otherwise contribute to the physical and emotional comfort of the students during learning activities. One optional aspect is adjustability allowing the same student desk 100 to be sized to accommodate different groups of students (e.g., elementary school students or high school students), to better fit individual students, or to convert the student desk between a sitting desk and a standing desk. Another optional aspect is to provide various opportunities for students to engage in the purposeful movements of brain-based movement that enhances learning without becoming a distraction. A still further optional aspect is to provide various integrated accessories with which students can interact and receive physical and mental stimulation to release physical and emotional energies in a calm, non-disruptive manner.

The student desk 100 includes a number of features implementing the optional aspects described above. The optional features of the student desk 100 include an adjustable height table, an adjustable depth table, an adjustable depth seat, an adjustable height seat, a spherical seating surface, a cushioned seating surface, a rotatable seat with twist resistance, a detachable or repositionable seat, a flexible backrest, a cushioned backrest, a tactile sensory strip, and resistance bands 116. Details of these optional features are discussed herein in reference to appropriate views of the student desk 100. All optional features are not shown in each view. The inclusion or omission of any optional feature from any view should not be construed limiting embodiments of the student desk to any particular combination of optional features. In a preferred embodiment, the student desk incorporates the adjustable height table, the cushioned spherical seating surface, the rotatable seat with twist resistance, the flexible backrest, the tactile sensory strip, and the resistance bands. However, student desks incorporating any combination of the various optional features described herein are contemplated to fall within the scope and spirit of the present invention.

In various embodiments, the resistance bands 116 are elastomeric bands 118 with a handle 120 at one end. In alternate embodiments, other types of resistance bands 116 may be used, such as a resistive system of cables and pulleys carried by the frame. The other end of each elastomeric band 118 is anchored to the frame 102. The resistance bands 116 may be anchored to the frame 102 using a variety of types and numbers of connectors 122 (or connection points). The parts of multi-part connectors may be distributed between the frame 102 and the resistance bands 116. For example, in the illustrated embodiment, the anchored end of the elastomeric band 118 is secured in an opening defined by the frame 102 (e.g., using a plug). While the illustrated embodiment shows a single connector, the frame 102 may include multiple connection points allowing the position of the resistance band to be changed. Examples of suitable connector types include, without limitation, a wide variety of fixed or releasable connectors or mounts (e.g., adhesives, a hook and eye connector, pins, snaps, nuts and bolts, plugs, etc.) allowing the resistance band to be easily moved or replaced to another location. Alternatively, the connectors may be associated with either the resistance bands 116 or the frame 102 and simply capture the other component. For example, the anchored ends of the resistance bands may include sleeves or cuffs that capture the frame and secure the resistance bands in place, or vice versa. The sleeves or cuffs may be closed and slid along the frame to the selected position or split with a closure (e.g., a hook and loop fastener) that fits around the frame and closed to secure the position of the resistance bands 116.

While shown with a single pair of resistance bands 116, the student desk 100 may incorporate any number of resistance bands 116, from an individual, unpaired resistance band to multiple sets of resistance bands. Further, different types of handles 120 may be utilized to accommodate different types of activities. For example, the handle 120 may be designed for gripping by a human hand or replaced by a strap intended to receive a human foot. In various embodiments, the handle 120 is detachable from the resistance band allowing substitution of different types of handles as desired. The student desk may optionally include one or more hooks or other attachment points (e.g., a handle hook and a pair of cord wrap hooks) or a retraction mechanism (e.g., a tensioned reel mounted to the frame or an externally accessible cord for pulling the length of the resistance band 116 into the frame) for storing the resistance bands 116 when not in use. Such storage components protect the resistance bands 116 and prevent them from becoming a trip hazard.

As previously mentioned, the primary purpose of the resistance bands 116 is to provide physical and/or mental stimulation to release physical and emotional energies in a calm, non-disruptive manner within a classroom setting. As such, only minimal resistance is needed to provide the desired cognitive benefit of brain-based movement. Accordingly, the amount of resistance provided by the resistance bands is typically low, e.g., less than 4.5 kg (10 lbs) and, preferably, less than 2.3 kg (5 lbs). The actual amount of resistance may be selected based on the target class of users. For example, higher resistance may be used with high school students than would be used for elementary school students. The low resistance is desirable for a number of reasons. First, if the amount of resistance provides more than a minimal physical challenge, students may direct focus to the physical activity rather than the learning activity and lose the cognitive benefits associated with brain-based movement. Minimal resistance also reduces the risk of injury, as well as suitability for disruptive, non-sanctioned uses of the resistance bands (e.g., using the resistance bands as projectiles or for competitive displays of strength).

The table support 110 include two or more telescopically connected frame members that are selectively extendable and compactable to adjust the height $h_w$ of the table 104 relative to the lowest point of the frame (e.g., the frame base 108). Such telescoping members are connected in a manner that allows a floating member 204 to slide along the length of the fixed member 202 to which it is connected.

As illustrated, the telescoping leg members 202, 204 are coaxially aligned tubular members with the outside dimensions of the floating leg member 204 being smaller than the inside dimensions of the fixed leg member 202. The telescoping leg members are illustrated as coaxial cylinders (i.e., circular cross sections); however, other configurations may be used. While basic shapes, such as circles, squares, and rectangles are most common, any elliptical or polygonal geometry may be used for the telescoping leg members. Similarly, while shown as a coaxial, the telescoping leg members 202, 204 may be arranged using a side-by-side or other suitable configuration. The table support 110 also includes a table position lock 206 for selectively fixing the relative position of the table support 110 to set the height of the table 104 within the available range of adjustment.

The length of the fixed member 202 generally determines the minimum height of the table 104 above the frame base 108 and the length of the floating member 204 generally determines the range of height adjustment of the table from the minimum height. Embodiments of the student desk 100 may offer different ranges of adjustment for the table height. In a preferred embodiment, a range of adjustment is provided sufficient to vary the table height $h_w$ from a first height suitable for use while the user is seated to a second height suitable for use while the user is standing. In other embodiments, a smaller range of adjustment may be provided to set the height of the table 110 at a general height appropriate for a selected class of users (e.g., elementary school students or high school students) or a customized height for a specific user.

In some embodiments, the table support 110 allows the table height to be set at pre-configured heights. For example, one example of a suitable table position lock 206 includes a linear arrangement of spaced apart apertures along the length of one or both leg members 202, 204 sized to receive a locking pin serving to fix the relative position of the telescoping members. The position of the telescoping leg members 202, 204 is fixed by aligning an aperture of the floating member with an aperture of the fixed member and inserting the pin to fix position of the floating member 202 and set the height of the table 104. Tethering the pin to the student desk 100 reduces the likelihood of losing the pin. Another suitable table position lock 206 is a detent that selectively fixes the relative position of the telescoping leg members 202, 204, such as a spring-biased pin configured to engage an aligned aperture in the other leg member 202, 204.

In various embodiments, the table support 110 allows the table height to be set at any height within the range of adjustment. For example, some embodiments of the table support 110 utilize a compression mechanism that fixes the relative position of the telescoping leg members 202, 204 through the application of friction. One suitable compression mechanism is a split collar or similar mechanism mounted at the top of the fixed leg member 204. The split collar is selectively tightened or loosened by turning a handle to increase or decrease the compressive forces applied to the floating member 202 thereby preventing or allowing movement of the table. Similarly, cylindrical telescoping members can have variations in the inner and outer radii (i.e. wall thickness) of the telescoping members 202, 204. Rotating one telescoping leg member 202, 204 to bring the thicker wall portions into contact makes or breaks a compression/frictional engagement between the telescoping leg members 202, 204 that enables or disables linear movement of the floating leg member 202. Where maintaining a selected orientation of one or both telescoping leg members 202, 204 is desirable, swivel collars are used to allow at least a portion of the one or both telescoping leg members 202, 204 to rotate.

The table position lock 206 of the illustrated embodiment includes a cross member connecting the fixed legs 204 of the table support 110. A handle 208 operatively engages and disengages the locking mechanism of the table position lock 206. For example, turning the handle 208 in a first direction causes pins to retract from apertures or relieves applied frictional pressure thereby disengaging the locking mechanism and allowing the floating member to move freely and turning the handle in the opposite direction re-engages the locking mechanism. In other embodiments, where the table support 110 utilizes two legs, the table position lock 206 may also suitably implemented using separate locking mechanisms.

In some embodiments, the table support 110 may employ multiple height adjustment features. For example, the table support 110 may employ a primary height adjustment for making gross height adjustments (e.g., changing between sitting and standing heights or between heights for a different classes of users) and a secondary height adjustment for making fine height adjustments.

In some embodiments, the table position lock 206 may be selectively disabled to control the ability to adjust the table height. For example, the table position lock 206 may incorporate an access control device (e.g., a key lock or a locking pin) that prevents the handle 208 from being turned or the table position lock 206 from being otherwise engaged.

Another suitable table position lock 206 includes a linear drive, such as a screw drive that adjusts the height of the table by moving the floating member relative to the fixed member by rotation of a least one threaded member (e.g., a threaded rod) in operative engagement with a cooperating threaded member. For example, a fixed threaded rod may be secured to the floating member and the height of the table adjusted and fixed by turning a threaded collar secured at the open end of the fixed member and causing the threaded rod to move the threaded collar. Alternatively, the threaded rod may be rotatable and received by a cooperating opening in the floating member such that rotation of the threaded rod causes the floating member to move along the length of the threaded rod. In various embodiments, the threaded rod or the threaded collar may be manually rotated (e.g., spinning the collar by hand or spinning the rod using a crank) or automatically using a motor. The direct physical connection due to the engagement of the threads holds the relative of position of the frame 102 members when the collar or rod is not being rotated.

Similarly, a hydraulic piston moving the floating member relative to the fixed member by increasing or decreasing the amount of a fluid in a constant volume cavity of the piston (e.g., via an air pump and release valve) or increasing or decreasing the volume of an adjustable cavity holding a constant volume of fluid in the piston are functions as a suitable table height adjustor.

The foregoing examples of table position locks 206 are intended to be illustrative of the wide variety of suitable mechanisms for adjusting the height of the table and should be read as limiting the student desk 100 to any specific arrangement or configuration.

To facilitate ease of adjustment, the table position lock 206 optionally includes a counter-balance mechanism that provides an assistive force when repositioning the table. In an exemplary counter-balance mechanism, a cable and pulley system having one end of the cable secured to the bottom of the floating tube and the other end secured to a counter-balance weight. By a weight or a spring with a resistive force strength that matches the weight of the floating tube(s) and the table, only a small amount of external force is required to break the equilibrium and raise or lower the table and allows the table to rest at the selected height little to no support from the user. This frees the user to engage the table height lock without requiring substantial effort on the part of the user to maintain the relative position of the frame 102 members while securing the table height lock.

In FIG. 2 and other views, the seat 106 is illustrated with the preferred seat shaped as a spherical cap 210 projecting from a seat base 212. The spherical cap 210 combined with the seat base 212 provides some of the benefits of a stability ball in a semi-stable platform. Specifically, rather than having a traditional, hard, substantially flat seating surface, the shape and flexibility of the spherical cap 210 promotes healthy posture and engages students' core abdomen and back muscles during all learning activities. However, unlike conventional stability balls and stability ball seating, the spherical cap 210 is mounted to the seat base 212 and does not move freely. Again, the goal of the student desk is to provide a work center that enhances learning by encouraging and facilitating appropriate brain-based movement within the classroom environment without becoming a distraction. Because the spherical cap 210 secured to the seat base 212 is not capable of rolling like a conventional stability ball, users are able to focus on educational activities rather than maintaining balance, regardless of the coordination of the user. Additionally, because the spherical cap 210 is not actually a ball and is anchored to the seat base 212, the opportunity and temptation to utilize the seat 106 as a toy is substantially diminished.

Another optional aspect of the student desk is the use of a flowable seat cushion in the spherical cap 210, such as a gel cushion. However, other materials, including air, that flow at typical climate-controlled indoor temperatures are appropriate. For example, a half stability ball, such as a BOSU® ball, or other similar apparatus may be appropriate for use as a seat surface. These types of seat materials provide substantial comfort compared to traditional hard seating surfaces. More importantly, because the seat cushion is a flowable material, the spherical cap 210 gives slightly in response movements of the student and forces the student to lightly engage the core muscles. Further, inflated stability balls and similar inflatable seating tend to exhibit significant amounts of bounce, which can resulting in students participating in educationally disruptive movements rather than brain-based movements. The seat cushion also provides a level of durability and vandalism resistance to the student desk because the seat is not subject to deflation if the skin of the spherical cap is punctured as would occur with a traditional fluid-filled stability ball.

Another aspect of the spherical cap is the varying height of the seating surface. Even without a height adjustable seat, a user can choose a seating position on the spherical cap 210 that provides an ergonomically appropriate seating height for the user. Sitting toward the outward edge of the spherical cap results in a lower seating height. Conversely, sitting more toward the center of the spherical cap 210 results in a higher seating height. Such seating position choices are impracticable when using a conventional stability ball because the seating further away from the vertical axis of the stability ball induces greater forces in the lateral direction tending to cause the stability ball to roll out from under the user.

Together, the spherical cap 210 housing the flowable cushion mounted on the seat base 212 provides a semi-stable seating platform that is sufficiently stable to allow students to remain comfortably seated without requiring a level of concentration that detracts from learning in order to remain balanced but still offers enough give to require engagement of core muscles so as to enhance learning with brain-based movement.

Figure 3A:
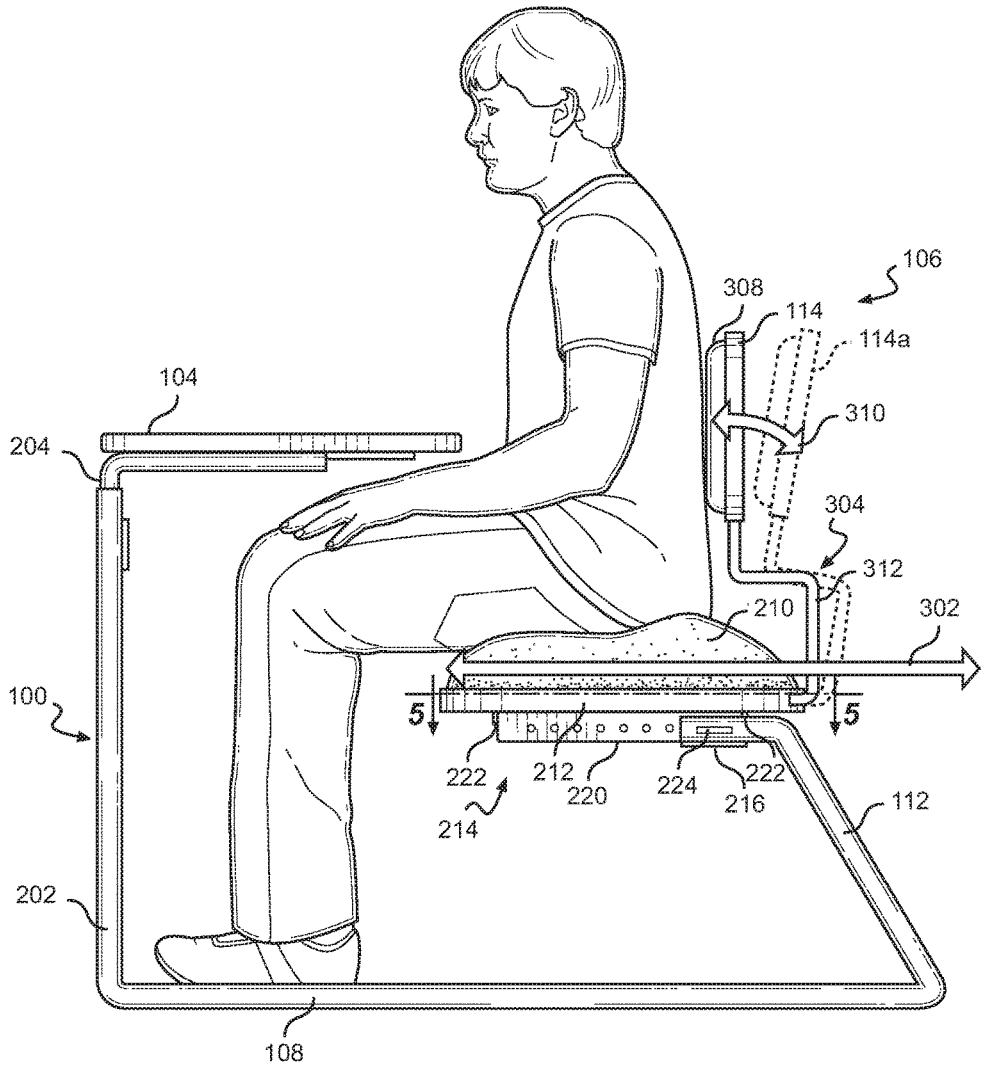
FIG. 3A is a right side elevation illustrating aspects of the student desk configured for use while a student is seated.
Figure 3B:
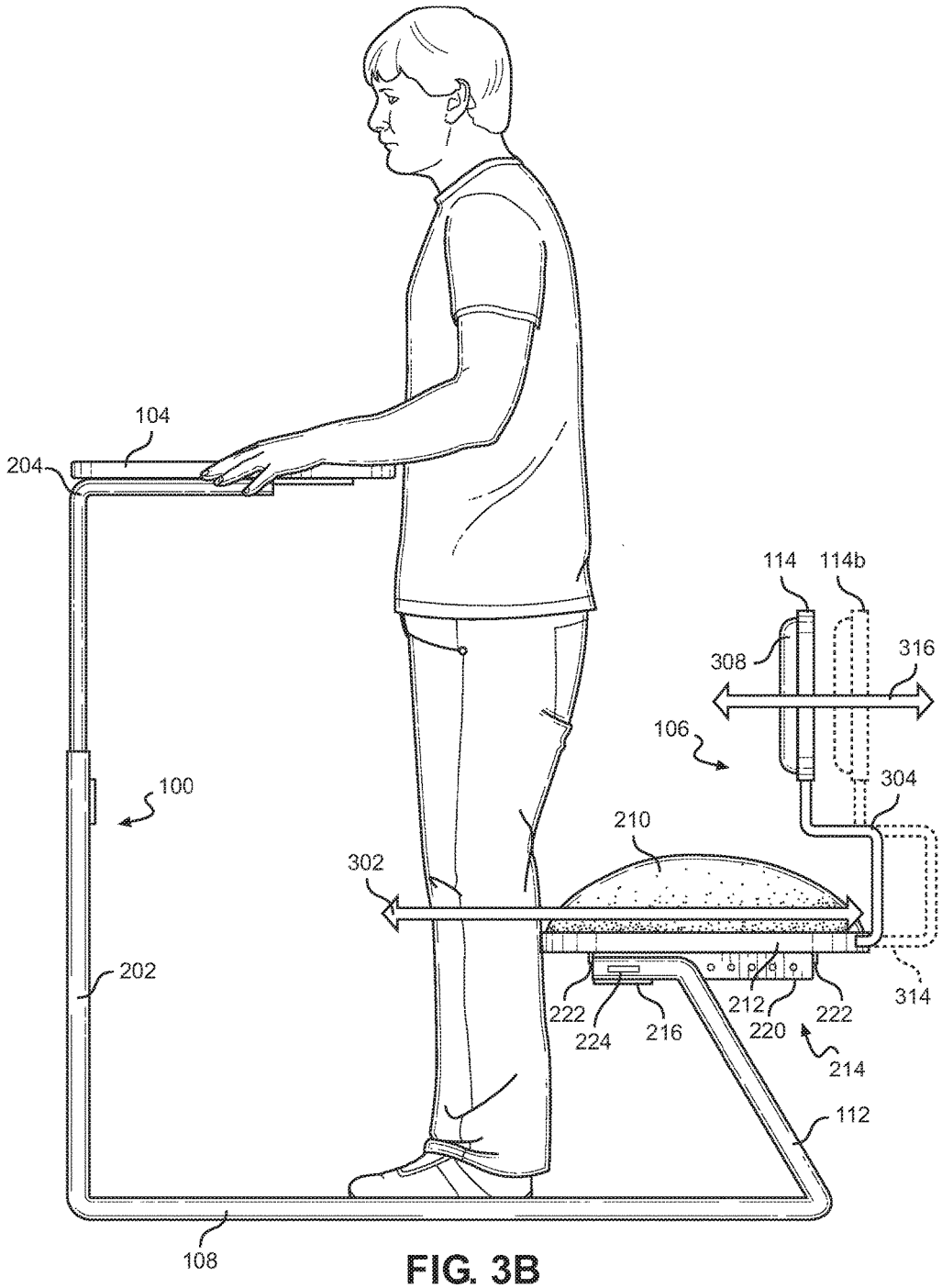
FIG. 3B is a right side elevation illustrating aspects of the student desk configured for use while a student is standing.
Figure 4:
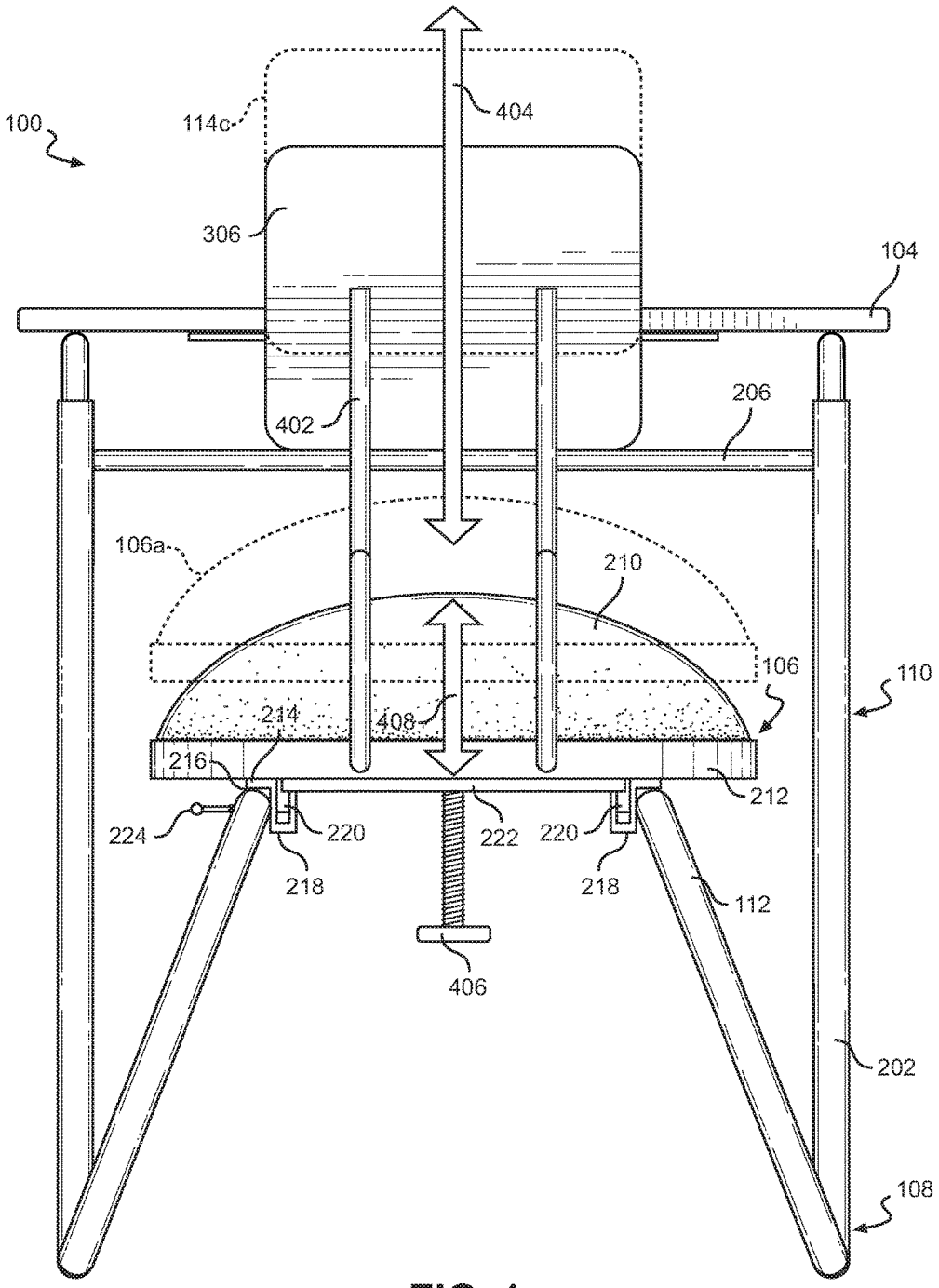
FIG. 4 is a rear elevation illustrating aspects of the student desk.

With reference to FIGS. 3A, 3B and 4, the position of the seat 106 is adjustable relative to the position of the table 104. In the illustrated embodiment, the seat 106 is attached to a carriage 214 and the frame 102 includes a guide 216 in operative engagement with the carriage 214. The guide 216 may be an integral component of the seat support 112 or a separate component mounted to the seat support 112. In one embodiment, the guide 216 defines one or more channels 218 and the carriage 214 includes a corresponding number of rails 220 that are received in the channels 218. The rails 220 are free to move forward or backward within the channels 218, and the channels 218 substantially prevent lateral movement of the rails 220. A stop 222 attached to each end of the carriage 214 operatively engages the end of guide 216 to limit the travel of the carriage 214. In various embodiments, friction between the carriage 214 and the guide 216 is reduced using a lubricant, bearings, rollers, or other friction reducing mechanism to provide smoother and easier movement of the seat 106. A seat lock 224 associated with the guide 216 operatively engages the carriage 214 to selectively fix the position of carriage 214. In the illustrated embodiment, the seat lock 224 that is biased to normally extend through a set of aligned openings in the guide 216 and the carriage 214 and prevent movement of the carriage 214.

The illustrated carriage 214, guide 216, and seat lock 224 are representative of the various suitable motive systems and corresponding locking systems that may be used to enable forward and backward movement of the seat and are not intended to limit scope of the motive systems and corresponding locking systems for the seat 106. Examples of other suitable motive systems include, but are not limited to, glides (e.g., drawer slides) and linear drives (e.g., a threaded drive rod). Likewise, another suitable seat lock 224 is a compression lock (e.g., a screw mounted to the guide that is tightened to apply pressure to the carriage).

When used as a seated desk, the minimum table height generally ranges from about 48.3 cm (19 in) for pre-school students to about 76.2 cm (30 in) for middle and high school students, when seated. Examples of suitable table heights for student at various grade levels are, without limitation, about 48.3 cm (19 in) to about 55.9 cm (22 in) for pre-school students, about 55.9 cm (22 in) to about 61.0 cm (24 in) for kindergarten students, about 61.0 cm (24 in) to about 63.5 cm (25 in) for first graders, about 61.0 cm (24 in) to about 68.6 cm (27 in) for second graders, about 63.5 cm (25 in) to about 68.6 cm (27 in) for third and fourth graders, about 68.6 cm (27 in) to about 76.2 cm (30 in) for students in the fifth grade and beyond. As a general rule, a two-part telescoping leg structure limits the table height from being raised to more than twice the fixed leg length. In practice, the overlap that occurs between the telescoping leg members limits the maximum table height to a value less than the twice the fixed leg length. Even with this limitation, a frame 102 having a two-part telescoping leg structure is suitable for use in a student desk 100 that is adjustable to accommodate students from pre-school to high school, when seated. It can be seen that the suitable minimum height typically increments by about 2.5 cm (1 in) to about 7.6 cm (3 in) for most increases in grade level. Thus, embodiments of the student desk 100 are provided with height adjustment mechanisms that are continuously adjustable or are adjustable in increments of about 2.5 cm (1 in), about 5.1 cm (2 in), or about 7.6 cm (3 in).

When used as a standing desk, the minimum table height of the student desk typically ranges from about 55.9 cm (22 in) for small pre-school and elementary school students up to about 119.4 cm (47 in) for students approaching approximately 193.0 cm (76 in). As a general rule, the appropriate standing table height is approximately 61% of the student's height. The greater range of adjustment required for standing use makes suitability of a single student desk across all grade levels more difficult to achieve. By sizing the student desk 100 based on median student stature in a range of approximately 99.1 cm (39 in) for a four-year old female of median stature and approximately 178.0 cm (70 in) for a 20-year old male of medium stature, a single student desk with a table height adjustable from about 61.0 cm (24 in) to about 109.2 cm (43 in) is achievable. Thus, a single frame size can be adjusted for use by students from pre-school to high school and beyond as a standing desk.

However, by providing differing sizes of frames targeting narrower ranges of students, more flexibility is available. For example, the median stature range for students is approximately 99.1 cm (39 in) to 114.3 cm (45 in) for students between the ages of 4 and 6, approximately 114.3 cm (45 in) to 150.0 cm (59 in) between the ages of 6 and 12, and approximately 150.0 cm (59 in) to about 178.0 cm (70 in) between the ages of 12 and 20. The stature differentials across these age ranges covering 90% of the student population (i.e., statures from the 5th percentile to the 95th percentile) are less than 35.6 cm (14 in), which requires a table height adjustment range of less than 22.9 cm (9 in). This amount of adjustment is less than half of even the median standing table height, i.e., about 61.0 cm (24 in), for pre-school to kindergarten students, leaving ample room to cover students below the $5^{th}$ percentile or above the $95^{th}$ percentile. For example, using only about 75% of the minimum standing table height of 48.3 cm (19 in), the available table height adjustment range is about 35.6 cm (14 in), which is suitable to cover a group of students with statures ranging from approximately 76.2 cm (30 in) to 137.2 cm (54 in). Similarly, 75% of the minimum standing table height of about 68.7 cm (27 in) covers a group of students with statures ranging from approximately 111.8 cm (44 in) and 195.6 cm (77 in). Thus, with as few as two frame sizes, e.g., minimum table heights of about 50.8 cm (20 in) and about 68.7 cm (27 in), the student desk is adjustable for use by virtually any student while standing. Moreover, these ranges of height adjustment encompass appropriate table heights for use while seated or standing, meaning a limited number of frame sizes can be used to produce student desks with an adjustable table height suitable for use while seated or standing. As with student desks for seated use, embodiments of are provided with height adjustment mechanisms that continuously adjustable or adjustable in increments of about 2.5 cm (1 in), about 5.1 cm (2 in), or about 7.6 cm (3 in).

As previously mentioned, optional aspects of the student desk include movement of the seat 106. Arrow 302 shows a representative range of forward and backward motion of the seat 106 using a motive system, such as the carriage 214 and guide 216 described earlier. Adjustment of the seat depth allows the distance between the seat 106 and the table 104 to be adjusted to fit a selected group of students or customized to a particular student. Further, because the frame 102 carries both the table 104 and the seat 106, the adjustable seat depth allows the user to move the seat 106 backwards to provide more leg room when standing and return it to a forward position for use while seated.

Similarly, in various embodiments, the table 104 is configured to move forward and backward in a manner similar to that described for the seat 106. Thus, the position of the table 104 can be adjusted relative to the seat 106.

In various embodiments of the student desk 100, the frame depth is adjustable using the same or similar structures as those described in reference to adjusting the table height, such as the telescoping leg members and table position lock. An adjustable depth frame may be used in conjunction with an adjustable depth seat to provide a greater range of adjustment than provided by the adjustable depth seat alone. When both an adjustable depth frame and an adjustable depth seat are employed, one component may provide a gross depth adjustment (i.e., large increments) while the other provides a fine depth adjustment (i.e., small increments). Alternatively, the adjustable depth frame may provide the sole mechanism for adjusting the position of a seat 106 that is fixedly mounted to the frame 102.

As depicted in FIG. 3A, the optional backrest 114 shown in the various views incorporates a number of optional features. When installed, the backrest 114 provides basic support that prevents students from sliding off the back of the spherical cap 210. Generally, the backrest 114 includes one or more backrest arms 304 that carry a back support 306. The back support 306 optionally includes a forward-facing cushion 308 for comfort. Various embodiments of the backrest 114 are flexible to provide a limited amount of recline (represented by backrest 114*a*, shown in phantom). The limited recline allows students to rock back and forth with a small range of motion, as shown by arrow 310, which is another brain-based movement activity. The small range of motion prevents the rocking from becoming disruptive to the learning environment but still serves as an effective calming technique or otherwise serves as an outlet for nervous energies. In various embodiments, the backrest arms 304 have a resilient portion 312, which may, for example, be fabricated from a resilient material (e.g., a resilient plastic or spring steel) or include a spring, biased hinge, or other resilient structure. Alternatively, non-resilient backrest arms 304 attached to the student desk 100 by a spring mount or other resilient mount may be used.

As depicted in FIG. 3B, some embodiments of the backrest 114 are moveable allowing the depth relative to the seat 106 to be adjusted (represented by the backrest 114*b*, shown in phantom). For example, the lower backrest arm rails 314 may be extended and slidably mounted to the seat base 212 (as shown), another seat component, or the frame 102 allowing the backrest 114 to be moved backward and forward with respect to seat, as shown by arrow 316. Alternatively, a portion of the seat base 212 carrying the backrest 114 may be moveable. A backrest lock is optionally provided to secure the backrest 114 in the desired position.

FIG. 4 is a rear elevation view illustrating further aspects of the student desk. In some embodiments, the height of the backrest 114 is adjustable (represented by the backrest 114*c*, shown in phantom). For example, the back support 306 may be slidably mounted on the vertical backrest arm rails 402 allowing the back support 306 to be moved vertically, as represented by arrow 404. A back support lock is optionally provided to secure the back support 114*c* at the desired height.

Similarly, in some embodiments, the height of the seat 106 is adjustable to accommodate different classes of students or customize the fit for individual students. From preschool to high school and beyond, the appropriate seat height ranges from about 25.4 cm (10 in) to about 45.7 cm (18 in) using increments ranging from 2.5 cm (1 in) to 5.1 cm (2 in). Examples of suitable seat heights for student at various grade levels are, without limitation, about 25.4 cm (10 in) to about 30.5 cm (12 in) for pre-school students, about 30.5 cm (12 in) to about 35.6 cm (14 in) for kindergarten students, about cm (12 in) to about 38.1 cm (15 in) for first graders, about 35.6 cm (14 in) to about 40.6 cm (16 in) for second graders, about 38.1 cm (15 in) to about 40.6 cm (16 in) for third graders, about 38.1 cm (15 in) to about 45.7 cm (18 in) for fourth graders, and about 45.7 cm (18 in) for students in the fifth grade and beyond.

With reference to FIG. 4, an option seat height adjuster 406 includes a threaded rod with a handle at one end and the other end connected to the seat base 212. The threaded rod is in engagement with a threaded receptacle in the guide 216 causing the seat to be raised or lowered as the handle is turned. Examples of other suitable seat height adjusters include, without limitation, linear drives and pneumatic or hydraulic lifts. Various embodiments of the seat height adjuster 406 are continuously adjustable or adjustable in increments.

As previously mentioned, optional aspects of the student desk include movement of the seat 106. Arrow 302 shows a representative range of forward and backward motion of the seat 106 using a motive system, such as the carriage 214 and guide 216 described earlier. Adjustment of the seat depth allows the distance between the seat 106 and the table 104 to be adjusted to fit a selected group of students or customized to a particular student. Further, because the frame 102 carries both the table 104 and the seat 106, the adjustable seat depth allows the user to move the seat 106 backwards to provide more leg room when standing and return it to a forward position for use while seated.

In various embodiments, the seat support height is also adjustable using the same or similar structures as those described in reference to adjusting the table height, such as the telescoping leg members and table position lock. An adjustable height seat support may be used in conjunction with an adjustable height seat to provide a greater range of adjustment than provided by the seat height adjustments alone or to reduce the amount of height adjustment provided by the seat height adjuster (e.g., to improve stability). When both an adjustable height seat support and an adjustable height seat are employed, one component may provide a gross depth adjustment (i.e., large increments) while the other provides a fine depth adjustment (i.e., small increments). For example, a frame 102 with a seat support positioning the seat 106 at a minimum height of about 25.4 cm (10 in) and four height settings in 5.1 cm (2 in) increments coupled with a seat height adjuster 406 providing up to an additional 5.1 cm (2 in) would cover the applicable range of seat heights. Also, as with the table height adjustments, frames with different, non-adjustable seat support heights may be employed to cover the applicable range of seat heights. Alternatively, the adjustable height seat support may provide the sole mechanism for adjusting the height of the seat 106.

It should be appreciated that the seat heights given are for the effective seat height, accounting for factors such as, but not limited to, the thickness of the spherical cap and the typical amount of compression of the spherical cap.

Figure 5:
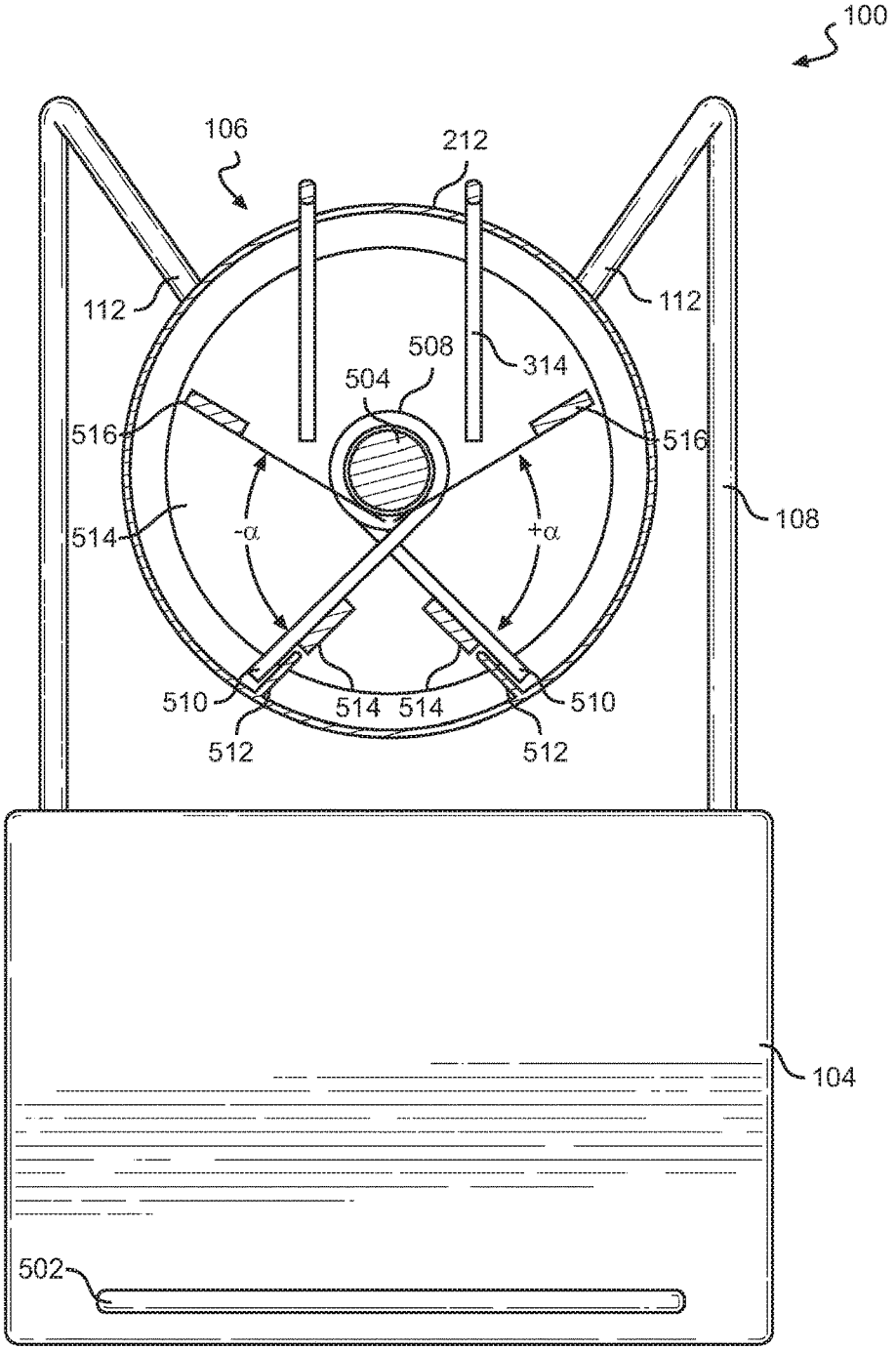
FIG. 5 is a top plan view of the student desk with the seat shown in section taken along section line 5-5 of FIG. 3A to illustrate aspects of the student desk.

FIG. 5 is a top plan view illustrating further aspects of the student desk. The table 104 is a substantially planar member carried by the table support 110. The table has a substantially flat top face configured to provide a smooth writing surface. Optional aspects of the table include one or more retention components 502 configured to retain a writing implement. In some embodiments, the retention components include an optional channel defined by the top face proximate and substantially parallel to one or more edges of the table with a depth selected to receive a writing implement and minimize the likelihood of the writing implement rolling off of the table 104. In some embodiments, the retention components 502 include an optional lip extending upwardly around the perimeter of the table with a height selected to minimize the likelihood of the writing implement rolling off of the table.

In an optional, but preferred embodiment, the seat 106 rotates allowing the user to twist both left and right while remaining seated and generally forward facing. To provide a consistent point of reference, forward facing is defined as having an angle $\alpha$ of 0°. As the intent is to allow movement that does not distract from the learning experience, the range of rotation of the seat 106 is limited. The seat 106 is not capable of 360° rotation to prevent the user from sitting and spinning the seat 106 until dizzy or otherwise creating a distraction. Thus, the maximum range of rotation is limited to no more than ±180° from the forward facing position. Rotating the seat 180° to face the user's rear neighbor or even ±90° to face the user's neighbors on either side facilitates social interactions, which may be educationally constructive (e.g., collaboration with another student) or educationally destructive (e.g., gossiping with another student or cheating off of another student). Accordingly, embodiments of the student desk 100 may limit the range of rotation to no more than about ±90°. In some preferred embodiments, the maximum angle of rotation from the forward facing position is limited to no more than about ±60°, about ±45°, or about ±30° so the user remains generally forward facing at all times. Other embodiments permit rotation to angles between ±90° and ±180° to allow more intensive physical activity and/or facilitate collaborative interactions. It is not practicable to list all possible upper bounds on the limit of rotation. The specific values of the maximum rotation angle are intended to be representative and not restrictive of the possible upper bounds.

In FIG. 5, the seat 106 is shown in cross-section along section line 5-5 from FIG. 3A to allow visualization of the internal components of one embodiment of the seat 106. In a preferred embodiment, the rotation of the seat 106 is resisted by a force biasing the seat 106 toward the forward facing position. In the illustrated embodiment, the seat base 212 is mounted on a hub 504 about which the seat 106 rotates. The seat base 106 forms an enclosure that houses one or more resistance elements 508 that act against rotation of the seat 106 from the forward facing position. In various embodiments, the resistance elements 508 include at least one torsion spring. The travel of each leg 510 of the torsion spring is constrained in one direction by a barrier 512 extending from a non-rotating plate 514 within the seat base 212 but remains free to move in the opposite direction. Each leg 510 operative engages a projection 512 (e.g., a tab) extending from and rotating with the seat base 212 that pushes the corresponding torsion spring leg 510. The torsion spring 508 opposes the rotation and pushes back against the projection 512 to provide the twist resistance for the seat 106. In various embodiments, a pair of oppositely wound torsion springs are used.

In some embodiments, the seat 106 includes variable rate resistance elements that increase the amount of resistance as the rotation increases, and the range of rotation is controlled by the resistance elements 508. In other words, rotation stops at the point when the resistance becomes too much for the user. Examples of variable rate resistance elements may be implemented through the use of non-linear resistance elements 508 (e.g., springs with increasing thickness or tighter coils. Likewise, multiple resistance elements may be arranged in a stepped configuration such that as target rotation angles are reached, more resistance elements are engaged to provide increased resistance.

However, in such arrangements, the amount of rotation varies from user-to-user based on the amount of twisting force that the user is able to apply. The resistance elements are sized to limit rotation to a preselected maximum angle for a typical user. However, stronger users may be able to go beyond the target rotation limit and weaker user may not be able to reach the target rotation limit. In a preferred embodiment, the seat 106 incorporates rotation limiters 516 that positively limit rotation of seat 106. When the operative portion of the resistance element 508 or the projection 512 makes contact with the rotation limiter 516 further rotation in that direction is prevented. Use of the rotation limiters 516 offers a number of benefits. First, the rotation limiters 516 allow lower resistance to be used, which makes it easier for all users to reach the maximum rotation angle because the rotational limits are controlled independently from the amount of resistance. Second, the rotation limiters 516 excessive stress from being exerted on the resistance elements thereby reducing wear and improving longevity. Third, the rotation limiters 516 allow a substantially consistent maximum rotation angle to be established for all users.

Other suitable resistance elements include, without limitation, tensioned cables, elastomeric bands, other types of springs, as well as more complex mechanical or electromechanical arrangements. For example, in some embodiments, the resistance bands may double as the resistance elements. In such an embodiment, the seat base 212 includes attachment points where the free ends or handles 120 of the resistance bands 116 are attached and routing extensions that hold and guide the elastomeric bands 118 in position so as to be operative to resist rotation of the seat. This arrangement may also double as storage for the resistance bands 116 when not in use.

When serving double duty as traditional resistance training components and resistance elements providing twist resistance to the seat, the level of resistance may be greater than the level of resistance mentioned earlier as desirable to facilitate educationally productive brain-based movement through resistance training. To address this issue, each resistance band 116 may include two or more elastomeric bands 118 that, when combined, provide the desired level of resistance against seat rotation. At least one of the elastomeric bands 118 is detachable from the handle 120 reduce the level of resistance for use in resistance training. In some cases, the additional elastomeric bands are permanently attached to the seat 106 to provide a base amount of twist resistance, which is supplemented by the resistance of the resistance band 116 used for resistance training when stored. Alternatively, the level of resistance provided by resistance bands 116 with a single low resistance elastomeric band 118 may be increased by arranging the routing members to limit the amount of the elastomeric band 118 that is engaged as the seat 106 rotates (i.e., effectively shortening the elastomeric band); however, it should be appreciated that using such solutions may overstress the engaged portion of the elastomeric band 118 during rotation and lead to premature failure of the resistance bands 116. Multiple elastomeric bands may be configured to provide resistance that increases in steps as described above.

Figure 6:
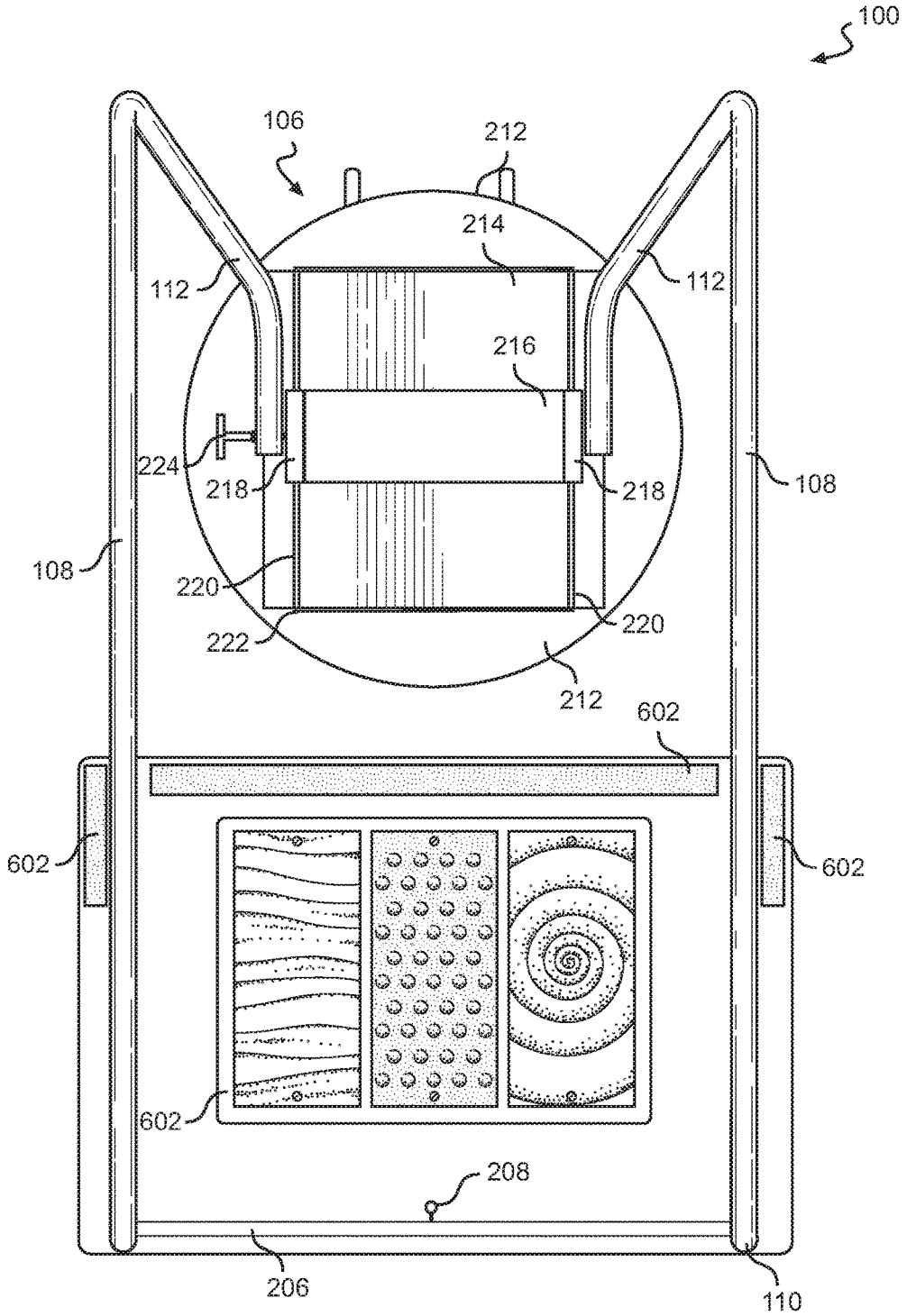
FIG. 6 is a bottom plan view illustrating aspects of the student desk.

FIG. 6 is a bottom plan view of the student desk 100. In a preferred embodiment, the bottom face of the table is optionally configured with a sensory relief 602 providing a readily accessible source of tactile stimulation for the user of the student desk 100. Generally, the sensory relief 602 includes one or more strips, sheets, or plates having at least one face that configured with various textures, protrusions, indentations, multi-level designs, or other features that are discernable through the sense of touch. The multiple sensory reliefs 602 in FIG. 6 show several of the suitable areas for placement, and the large central sensory relief 602 illustrates representative sensory relief designs.

Tactile stimulation is known to be valuable for managing mental health conditions that interfere with the ability to focus or stay on task such as, but not limited to, autism spectrum disorder (ASD), attention deficit hyperactivity disorder (ADHD) as well as many different types of anxiety, conduct, and developmental disorders. However, introducing tactile stimulation in an educational setting in a productive way is often challenging. The typical solution is to use handheld manipulatives to provide tactile stimulation. Although handheld manipulatives are beneficial for addressing the need for stimulation, they occupy the user's hand, limiting the user's ability to engage in activities, such as writing or turning pages in a book. Handheld manipulatives are also subject to becoming projectiles. While a user can simply put a handheld manipulative down to undertake another activity, the cycle of putting a handheld manipulative down and picking it back up becomes distracting. Further, temporarily putting a handheld manipulative down requires space in the user's work area, which is often at a premium in classroom settings. Even if the manipulative is usable without being held (e.g., while resting on work surface), it still takes valuable work space away from the user.

Handheld manipulatives and other tactile stimulation devices are likely to be readily available in a classroom dedicated to special needs education but not in a regular classroom. In educational settings that integrate, rather than segregate, special needs learners the availability of the sensory relief 602 on the underside of the table 104 provides those special needs learners with access to the necessary tactile stimulation at all times without involving a classroom disruption. This also benefits students without special needs who would not otherwise have access to educationally productive tactile stimulation.

In general, sensory reliefs 602 can be positioned anywhere on the table 104 other than the top surface, which is reserved for use as a work surface and for which a substantially flat, smooth, surface is desirable. In preferred embodiments, the sensory relief 602 is positioned on the underside of the table 104 at positions that are readily and discretely accessible by the user of the student desk 100. In particular, preferred locations for placement of the sensory relief 602 are the underside regions of the table 104 proximate to the edge and/or corners nearest the user. Other suitable locations for placement of the sensory relief 602 include underside of the table 104 proximate to the side edges, on the sides of the table 104, and the central region of the underside of the table 104. In general, sensory reliefs 602 can be positioned anywhere on the table 104 or other component of the student desk 602 that can be reasonably reached by the user of the student desk, with the notable exception of the top surface, which is reserved for use as a work surface and for which a substantially flat, smooth, surface is desirable.

Because the sensory relief 602 is carried by the table 104 in a way that does not take up work space, users can benefit from tactile stimulation with a little to no disruption of learning activities. For example, instead of merely resting their hands in their laps or on the table top, users can freely touch the sensory relief 602 on the underside of the table, reach up to turn the page, and return to touching the sensory relief 602 without ever taking focus away from the reading (e.g., to find a spot to place the manipulative or locate a manipulative that has been put down). Similarly, the sensory relief 602 can be touched during writing activities while still holding on to a pencil. In other words, the user is not required to put down the pencil in order to hold the manipulative, which makes it practicable for the user to interact with the sensory relief 602 when not actively writing (e.g., while thinking about an answer) without the interruption normally associated with trading out the pencil for a hand-held manipulative.

In some embodiments, the sensory relief 602 independent component that can be added to an existing student desk 100 not currently outfitted with a sensory relief. Preferably, the sensory relief 602 is selectively detachable from the student desk 104 to allow replacement, substitution, or cleaning as needed. In a preferred embodiment, the sensory relief 602 is securely attachable to the underside of the table 104 to prevent unauthorized removal. In various embodiments, the table includes a secure (e.g., lockable) receptacle for receiving a sensory relief 602 and defines a port exposing the touching surface of the sensory relief 602. In other embodiments, the table 104 includes a cover with a central opening that captures the sensory relief 602 against the underside of the table 104. In other embodiments, the sensory relief 602 is secured to the underside of the table via one or more fasteners (e.g., screws, staples, snaps, and other mechanical fasteners) or adhesives. In still other embodiments, the sensory relief 602 is fabricated as an integral part of the underside of the table 104 (i.e., the bottom face of the table is the sensory relief).

Returning to FIGS. 1 and 2, there is also provided an optional swinging footrest 124 that is rotatably mounted between vertical leg members 202 of the supports 102. The swinging footrest 124 is generally U-shaped having vertical side members and a horizontal center bar disposed between the vertical side members. The center bar of the footrest 124 is located so that an occupant of the desk 100 can extends her feet outwards and place them onto the center bar. Horizontal extensions extend laterally outwards from the vertical side members of the footrest 124 and are rotatably mounted to the vertical leg members 202. The footrest 124 is mounted at a suitable height to allow it to swing freely without contact the floor surface and to allow an occupant to easily place her feet onto the center bar.

The swinging footrest 124, as with all of desk components, provides the student opportunities for purposeful movement that stimulates the cerebellum increasing attention control and boosting cognitive performance. The swinging footrest also discourages counterproductive and oppositional behaviors by empowering the student to interrupt negative thinking, self-soothe with movement, regain emotional balance, and learn more adaptive academic and social behaviors in the classroom. While in a seated position, the student rests feet on swinging bar with legs in a slightly elevated position and a slight bend at the knee to gently sway backward and forward. In addition to the benefits of increased brain stimulation and attention control, the purposeful and repetitive swaying has a calming and centering effect for special needs learners and mainstream students. The swinging footrest 124 can be made of metal (illustrated), plastic (pvc), rope, resistance band, etc. to achieve desired purposeful movement.

In certain embodiments, safety measures are incorporated into the design of the footrest 124 to ensure that it cannot swing in a reckless manner and that it can be easily removed if necessary. For example, a safety stop and/or swing limiting device can be achieved by attaching a bracket and governing flange system at the two pivot pin/hinge point sites located at the junction between the vertical leg members 202 and the horizontal extensions extending laterally from the U-shaped footrest 124. Brackets and governing flanges can be secured by mechanical fasteners inside or outside the hollow desk leg. Additionally, a torsion spring system with governing barriers may also be appropriate to safely manage swinging footrest. A simple heavy duty bushing system designed to connect and limit footrest movement at the pivot pin/hinge point sites is also suitable. Footrest 124 can be immobilized by pin insertion, tightening thread rod, etc. Generally speaking, any safe and efficient combination of mechanical fasteners, governing barriers, bushings, and immobilizing hardware could be appropriate. Additionally, while the footrest 124 is not meant to be attached or detached by the student, it can be easily attached or detached by an adult using mechanical tools that correspond with the desk's hardware (ex. set screws and Allen wrench).

The illustrated student desk 100 includes all standard and optional components in a single embodiment. While each different combination of components of the student has not been separately depicted, it should be appreciated that one or more of the optional components may be omitted from the student desk 100 and different optional components combined together to create alternate embodiments of the student desk 100 without departing from the scope and spirit of the present invention. It should be appreciated that the values and ranges used herein are intended to showing examples of working ranges and should not be considered as limiting. Other values, including fractional values, and other range boundaries may be used without departing from the scope and spirit of the present invention.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A student desk configured to incorporate brain-based movement into learning activities comprising:

a frame comprising a table support including leg member portions extending upwardly from a front portion of the frame and a non-rotating seat support extending upwardly from a rear portion of the frame;

a rotatable seat carried by the seat support and configured to rotate about the non-rotating seat support from a resting position to a first ending position in a first direction and from a resting position to a second ending position in a second direction;

a table carried by the table support, the table having a substantially flat and smooth top face, a bottom face, and a near edge proximate to the seat;

a sensory relief disposed a surface of the table other than the top face, the sensory relief comprising at least one face having at least one tactilely discernable feature accessible by a user of the student desk;

a swinging footrest rotatably mounted between the leg member portions of the frame;

a torsion spring having a pair of legs;

a pair of barriers disposed on the seat support and associated with the torsion spring, each barrier configured to remain stationary while the seat rotates and to prevent one leg of the torsion spring from traveling in one direction from the resting position; and a pair of projections extending from the seat and operatively engaging one leg of the torsion spring, each projection moving with the seat as the seat rotates, the torsion spring opposing rotation of the seat by applying a force to the projection via the associated leg.

2. The student desk of claim 1 wherein the footrest is generally U-shaped and comprises vertical side members and a horizontal center foot contact bar disposed between the vertical side members, and horizontal extensions extending laterally outwards from the vertical side members of the footrest that are rotatably mounted to the leg member portions of the frame.

3. The student desk of claim 1 wherein the seat rotates laterally and wherein a resistance element is operatively connected to the seat to oppose rotation.

4. The student desk of claim 1 wherein the table support comprises at least one telescoping leg and at least one position lock, the telescoping leg being extendable and retractable to vary the height of the table, the position lock preventing extension and retraction of the telescoping leg to fix the height of the table when engaged.

5. The student desk of claim 4 wherein table is movable between a sitting height and a standing height.

6. The student desk of claim 1 wherein the seat is moveable between a forward position and rearward position to vary the distance between the table and the seat.

7. The student desk of claim 6 further comprising:

a guide attached to the seat support;

a carriage attached to the seat and the guide, the carriage moveable along the guide between a forward position and rearward position; and a position lock connecting the carriage to the guide and fixing the position of carriage when the position lock is engaged.

8. The student desk of claim 1 wherein the frame is extendable and retractable to vary the distance between the table and the seat.

9. The student desk of claim 1 wherein the seat is extendable and retractable to vary the distance between the table and the seat.

10. The student desk of claim 1 wherein the first ending position and the second ending position have a maximum angular displacement of about 90° from the resting position.

11. The student desk of claim 1 further comprising:

a pair of projections extending from the seat and moving with the seat as the seat rotates; and a pair of rotation limiters, each rotation limiter disposed on a path travelled by one of the projections at a position corresponding to the maximum angular displacement of the seat, each rotation limiter remaining stationary while the seat rotates and blocking travel of the corresponding projection beyond that position thereby preventing the seat from rotating past the maximum angular displacement.

12. The student desk of claim 1 wherein the torsion spring has a variable rate of resistance that increases as the angular displacement of the seat from the resting position increases.

13. The student desk of claim 1 wherein the sensory relief is releasably secured to the table.

14. The student desk of claim 1 wherein the sensory relief is disposed on the table bottom face proximate to the near edge.

15. The student desk of claim 1 further comprising a pair of resistance bands secured to the frame.

16. The student desk of claim 1 wherein the seat includes a spherical cap, which spherical cap houses a gel cushion.

17. The student desk of claim 1 further comprising a backrest, the backrest being flexibly mounted to the seat.

18. The student desk of claim 17 wherein the backrest further comprises at least one support arm carrying a back support, the support arm having at least a resilient portion allowing the backrest to flex.

19. A student desk comprising:

a frame comprising a table support and a non-rotating seat support;

a rotatable seat carried by the seat support and configured to rotate about the non-rotating seat support from a resting position to a first ending position in a first direction and from a resting position to a second ending position in a second direction;

a table carried by the table support;

a torsion spring having a pair of legs;

a pair of barriers disposed on the seat support and associated with the torsion spring, each barrier configured to remain stationary while the seat rotates and to prevent one leg of the torsion spring from traveling in one direction from the resting position; and a pair of projections extending from the seat and operatively engaging one leg of the torsion spring, each projection moving with the seat as the seat rotates, the torsion spring opposing rotation of the seat by applying a force to the projection via the associated leg.

* * * * *